US007856302B2

(12) United States Patent
Rasmussen

(10) Patent No.: US 7,856,302 B2
(45) Date of Patent: Dec. 21, 2010

(54) WORK MACHINE WITH TRANSITION REGION CONTROL SYSTEM

(75) Inventor: Terry L. Rasmussen, Princeville, IL (US)

(73) Assignee: Caterpillar Inc, Peoria, IL (US)

( * ) Notice: Subject to any disclaimer, the term of this patent is extended or adjusted under 35 U.S.C. 154(b) by 1187 days.

(21) Appl. No.: 11/315,264

(22) Filed: Dec. 23, 2005

(65) Prior Publication Data

US 2007/0150148 A1 Jun. 28, 2007

(51) Int. Cl.
*G06F 7/70* (2006.01)
*A01B 33/00* (2006.01)
*E01C 23/07* (2006.01)

(52) U.S. Cl. ..... 701/50; 172/45; 404/84.1; 404/84.5

(58) Field of Classification Search ..... 701/50; 172/45

See application file for complete search history.

(56) References Cited

U.S. PATENT DOCUMENTS 5,356,238 A * 10/1994 Musil et al. ..... 404/84.1
5,375,663 A 12/1994 Teach
5,549,412 A 8/1996 Malone
5,764,511 A 6/1998 Henderson
6,227,761 B1 5/2001 Kieranen et al.
6,324,455 B1 11/2001 Jackson
6,530,720 B1 3/2003 Green
6,530,721 B2 * 3/2003 Yost ..... 404/84.5
6,672,797 B1 1/2004 Zachman et al.
6,880,643 B1 4/2005 Zimmerman et al.
2004/0086337 A1 5/2004 Zachman et al.

* cited by examiner

*Primary Examiner*—Khoi Tran
*Assistant Examiner*—Ian Jen
(74) *Attorney, Agent, or Firm*—Finnegan, Henderson, Farabow, Garrett & Dunner LLP

(57) ABSTRACT

A transition region control system has one or more sensors configured to transmit a signal representative of a speed of a work machine moving over a first surface. The transition region control system also has one or more surfacing components configured to form a second surface generally coplanar to the first surface, wherein the second surface may include a transition region generally non-coplanar to the first surface. The transition region control system further has a data input system configured to transmit data representative of the transition region to a controller. The controller may be configured to determine the speed of the work machine based on the signal received from the one or more sensors and control the operation of at least one of the one or more surfacing components to at least partially form the transition region based on the speed of the work machine and the data representative of the transition region.

21 Claims, 3 Drawing Sheets

WORK MACHINE WITH TRANSITION REGION CONTROL SYSTEM

TECHNICAL FIELD

The present disclosure relates to a work machine with a transition region control system, and more particularly, to a work machine with a transition region control system for controlling the formation of a new surface.

BACKGROUND

During roadway construction, paving machines may be used to deposit paving material to form a roadway surface. Because paving material can be expensive and is often used in large quantities, applying paving material with a thickness that deviates from a desired thickness can be inefficient. Paving material applied too thickly may be unnecessarily expensive and exhausted before the roadway surface is complete, and material applied too thinly may result in premature failure of the roadway surface due to reduced load-bearing properties.

Roadway construction may also require milling operations to remove roadway material. Over time an asphalt surface may become misshapen or otherwise unsuitable for vehicular traffic due to various factors, such as, for example, roadway usage, temperature variation, moisture variation, and physical age. In order to rehabilitate roadways for continued vehicular use, spent asphalt may be removed in preparation for resurfacing.

Road milling machines may be configured to scarify, remove, or reclaim material from the surface of bituminous, concrete, or asphalt roadways and other surfaces using a planing tool. Typically, road milling machines may also include adjustable lifting members to control the depth of cut by raising or lowering the planing tool. Actuation of the lifting members may be controlled by a machine operator or other suitable control mechanism.

To construct roadways of suitable quality, both paving and milling operations may require the addition or removal of paving material of a certain thickness. Conventional paving or milling operations may use string-lines or multiple grading stakes placed about the worksite as reference points. An operator may use the reference points to ensure that an appropriate thickness of material is added or removed to form a desired surface. The accuracy of surface formation may be dependent upon the number of grade stakes used and the distance between each grade stake. For large worksites, stake placement can be a lengthy and tedious process. Further, during paving or milling operations, additional personnel may be required to monitor the operation to ensure that the newly formed surface is of suitable quality.

One method of forming new surfaces without the use of grade stakes includes a laser plane configured as a reference point. During operation, a work machine may reference the laser plane while adding or removing material in order to create a desired surface. One such system is disclosed in U.S. Pat. No. 6,227,761 ("the '761 patent"), to Kieranen et al., issued May 8, 2001. The system disclosed in the '761 patent may be used to form three-dimensional curved surfaces. The system includes a controller for controlling the contouring assembly and a tracking device to track the position of the contouring assembly.

However, the system of the '761 patent defines a surface using a complex set of instructions. Three coordinates are required to define a node, and multiple nodes are required to define the surface. A user must select a minimum of three or four nodes to define a surface, and even more must be selected to define more complex surfaces. The system of the '761 patent increases the complexity and associated costs of the contouring operation and may be overly complicated for many applications.

The transition region control system of the present disclosure is directed towards overcoming one or more of the problems set forth above.

SUMMARY OF THE INVENTION

One aspect of the present disclosure is directed toward a transition region control system. The transition region control system includes one or more sensors configured to transmit a signal representative of a speed of a work machine moving over a first surface. The transition region control system may also include one or more surfacing components configured to form a second surface generally coplanar the first surface, wherein the second surface may include a transition region generally non-coplanar to the first surface. The transition region control system further includes a data input system configured to transmit data representative of the transition region to a controller. The controller may be configured to determine the speed of the work machine based on the signal received from the one or more sensors and control the operation of at least one of the one or more surfacing components to at least partially form the transition region based on the speed of the work machine and the data representative of the transition region.

Another aspect of the present disclosure is directed to a method for controlling a work machine. The method includes determining a speed of the work machine moving over a first surface and receiving data from a data input system, wherein the data may be representative of a transition region generally non-coplanar to the first surface and included within a second surface generally coplanar to the first surface. The method also includes controlling at least one of the one or more surfacing components configured to form the second surface to at least partially form the transition region based on the speed of the work machine and the data representative of the transition region.

DETAILED DESCRIPTION

Figure 1:
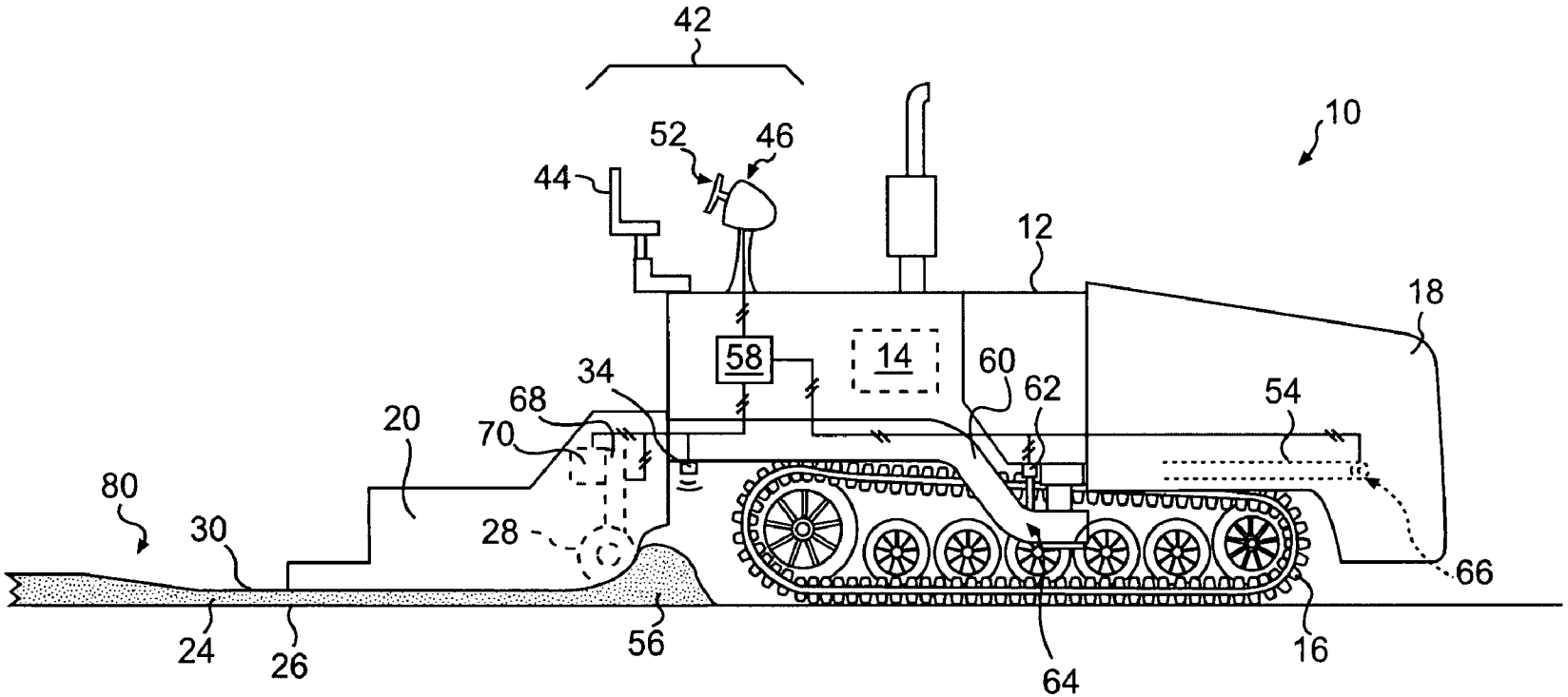
FIG. 1 is a diagrammatic representation of a work machine, according to an exemplary embodiment.

FIG. 1 is a diagrammatic representation of a work machine 10, according to an exemplary embodiment. Work machine 10 may include a tractor 12, a hopper 18, a screed 20, and a transition region control system (TRCS) 58. In some embodiments, work machine 10 may include an asphalt paver or similar machine configured to add material to a surface 26. Alternatively, work machine 10 may be configured to remove material from surface 26. For example, work machine 10 may include a milling machine or similar device configured to remove asphalt and/or other materials from surface 26. As shown in FIG. 1, work machine 10 may be configured to add a material 24 to surface 26 to form a new surface 30. Material 24 may include asphalt, concrete, loose aggregate materials such as crushed gravel, or any suitable material used to construct roadways, pavements, or other surfaces.

Tractor 12 may be configured to propel work machine 10. Tractor 12 may include a power source 14, one or more traction devices 16 (e.g., wheels, tracks, etc.), and an operator station 42. Power source 14 may be configured to provide mechanical and/or electrical power to various parts of work machine 10 using a variety of suitable engine types, such as, for example, an internal combustion engine, an electric generator, or any other suitable power source. Further, power source 14 may be operably coupled to various parts of work machine 10 via drivetrain components, electrical wires, fluid conduits, or any other suitable connection.

Tractor 12 may include any device and/or system configured to control an operation of work machine 10. These control systems and devices may be located, for example, within operator station 42. Operator station 42 may include a seat 44 and a console 46 mounted on tractor 12. Console 46 may include one or more controls 52 configured to allow an operator to control an operation of work machine 10, such as, for example, a speed or a direction of tractor 12. Console 46 may also be configured to display information associated with an operation of work machine 10.

Work machine 10 may include hopper 18 for containing material 24. Material 24 may be transferred from hopper 18 and deposited behind tractor 12 to form a pile 56. As work machine 10 moves forward, screed 20 may pass over pile 56. Screed 20 may be attached to tractor 12 by one or more tow arms 60 and towed behind tractor 12 to evenly spread and compact material 24 to form new surface 30.

Work machine 10 may include TRCS 58 configured to control various operations of work machine 10. For example, if work machine 10 is configured to remove material from surface 26, TRCS 58 may control an operation of work machine 10 during the removal of material from surface 26. Alternatively, if work machine 10 is configured to add material 24 to surface 26, TRCS 58 may control an operation of work machine 10 during the addition of material 24 to surface 26. Specifically, TRCS 58 may be configured to control an operation of work machine 10 such that new surface 30 formed by work machine 10 may include a transition region 80.

Typically work machine 10 may form new surface 30 such that new surface 30 may be generally coplanar to surface 26. However, new surface 30 may also include transition region 80 generally non-coplanar to surface 26 if the height of material 24 added to or removed from surface 26 varies. For example, a roadway may require transition region 80 in the vicinity of a bridge. The height of material 24 may be reduced as the roadway approaches the bridge in order to form a smooth transition from the roadway surface to the bridge surface.

Transition region 80 may be a region of new surface 30 generally non-coplanar to surface 26. As shown in FIG. 1, transition region 80 may be sloped generally parallel to the direction of motion of work machine 10. As work machine 10 moves forward, work machine 10 may also gradually decrease the height of material 24 formed on surface 26. In other embodiments, transition region 80 may be sloped generally perpendicular to the direction of motion of work machine 10, termed superelevation or cross-slope. For example, a roadway may require varying superelevations depending on anticipated vehicular use and traffic conditions. A highway turn may require a greater superelevation through the apex of the turn and a lesser superelevation leading into the turn. Work machine 10 may be configured to control the superelevation of material 24 formed on surface 26 by controlling the cross-slope of one or more components of work machine 10.

Figure 2:
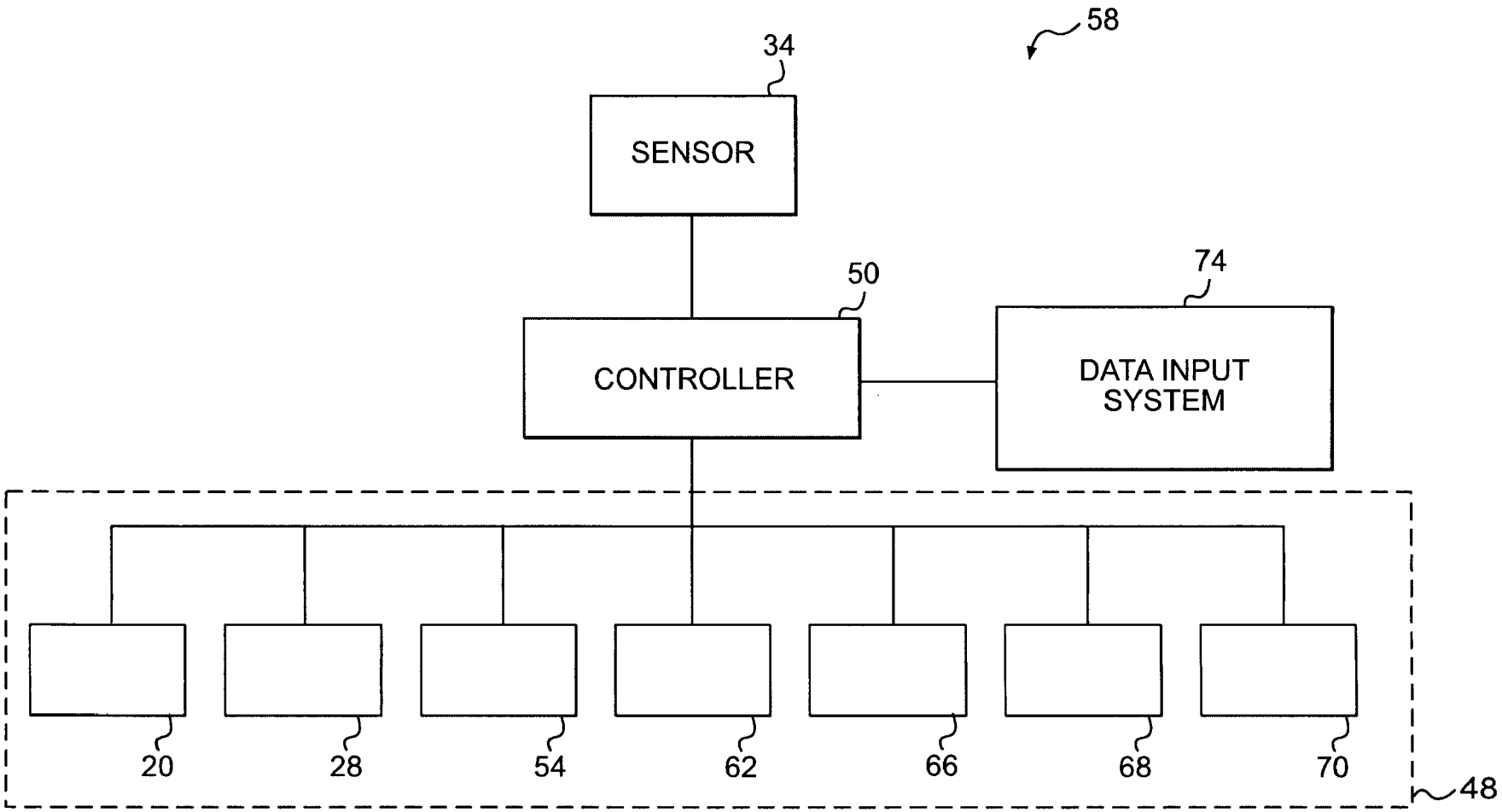
FIG. 2 is a block diagram representation of a transition region control system, according to an exemplary embodiment.

FIG. 2 is a block diagram representation of TRCS 58, according to an exemplary embodiment. TRCS 58 may include a sensor 34, one or more surfacing components 48, a data input system 74, and a controller 50. In some embodiments, TRCS 58 may determine the speed of work machine 10 based on a signal received from sensor 34. TRCS 58 may also receive data representative of transition region 80 from data input system 74. Based on the speed of work machine 10 and the data representative of transition region 80, TRCS 58 may control the operation of surfacing components 48 of work machine 10 to control the formation of transition region 80.

Sensor 34 may be configured to monitor an operational parameter of work machine 10, such as, for example, a speed, a position, a movement, a direction, or any other suitable operational parameter. In some embodiments, sensor 34 may be configured to monitor a speed of work machine 10. For example, sensor 34 may be configured to monitor a speed of traction devices 16, tractor 12, screed 20, or any component of work machine 10. Sensor 34 may include non-contact or contact sensors; such as, for example, sonic sensors, infrared sensors, radar sensors, gage wheels, or any other suitable monitoring devices known in the art.

Sensor 34 may be configured to transmit a signal representative of an operational parameter of work machine 10. For example, sensor 34 may be configured to transmit a signal representative of a speed of work machine 10. Sensor 34 may transmit any suitable type of electrical signal, such as, for example, an analog or a digital signal. The signal transmitted from sensor 34 may be representative of a speed of work machine 10 or may permit one or more components of TRCS 58 to determine a speed of work machine 10.

Work machine 10 may include one or more surfacing components 48. Surfacing components 48 may include one or more devices and/or systems configured to form new surface 30. In some embodiments, surfacing components 48 may be configured to form transition region 80 via the addition or removal of material 24. For example, work machine 10 may include surfacing components 48 configured to add material 24 to surface 26 to form transition region 80. Alternatively, work machine 10 may include surfacing components 48 configured to remove material 24 from surface 26 to form transition region 80.

In some embodiments, surfacing components 48 may include one or more devices and/or systems configured to form pile 56. For example, surfacing components 48 may transfer material 24 from hopper 18 to form pile 56. Surfacing components 48 may include one or more conveyors 54 (FIG. 1) positioned at the base of hopper 18. Conveyors 54 may be configured to transport material 24 from hopper 18 to the rear of tractor 12 where it may be deposited in front of screed 20 in pile 56.

Surfacing components 48 may also control the movement of material 24 from hopper 18 to pile 56. Specifically, surfacing components 48 may include a conveyor motor 66 configured to power conveyor 54 and control the formation of pile 56. For example, decreasing the speed of conveyor motor 66 may decrease the size of pile 56 to gradually decrease the height of material 24 formed by work machine 10.

Work machine 10 may also include screed 20 configured to spread pile 56 and compact material 24. The height of screed 20 may be adjusted by raising or lowering tow arms 60 at a tow point 64. Surfacing components 48 may include one or more screed height actuators 62 configured to adjust the height of screed 20. Screed height actuators 62 may be any suitable actuators, such as, for example, hydraulic cylinders. When work machine 10 is in motion, screed 20 may float on material 24 at a substantially constant height relative to the height of tow arms 60 at tow points 64. Screed height actuators 62 may increase or decrease the height of screed 20 to increase or decrease the thickness of material 24 deposited on surface 26.

Screed 20 may include an auger 28 for spreading pile 56 evenly beneath screed 20. In an exemplary embodiment, work machine 10 may include two augers 28, which may be aligned end-to-end and situated crossways within screed 20. Each auger 28 may be powered by an auger motor 70 wherein auger motor 70 may include any suitable motor configured to power auger 28. Surfacing components 48 may include one or more auger motors 70 configured to control the speed of augers 28. Varying the speed of auger motors 70 may vary the lateral distribution of material 24 formed under screed 20. For example, the speed of a left-side auger may be increased relative to the speed of a right-side auger to distribute more material 24 under the left-side of screed 20. By controlling the speed of left and right-side augers, surfacing components 48 may control the formation of different superelevations of new surface 30.

In some embodiments the height of auger 28 may be adjusted. Auger height may be adjusted to position auger 28 at a height above surface 26 to sufficiently spread pile 56. Surfacing components 48 may include one or more auger height actuators 68 configured to adjust the height of auger 28. Auger height actuators 68 may include any suitable actuators, such as, for example, hydraulic cylinders. When work machine 10 is in motion, auger height actuators 68 may be adjusted to increase or decrease the height of auger 28 to increase or decrease the thickness of material 24 formed under screed 20. It is also contemplated that left and right-side auger height actuators 68 may be adjusted independently to form various superelevations of material 24. Auger height actuators 68 may be adjusted to vary the thickness and/or superelevation of material 24 during the formation of transition region 80.

Surfacing components 48 may include any devices and/or systems of work machine 10 configured to form new surface 30 and/or control the formation of new surface 30. For example, surfacing components 48 may include screed 20, auger 28, conveyer 54, or any other components known in the art. In some embodiments, surfacing components 48 may include components to control screed 20, auger 28, conveyer 54, such as, for example, screed height actuator 62, auger height actuator 68, conveyer motor 66, or auger motor 70. However such surfacing components 48 are exemplary and not intended to be limiting. For example, surfacing components 48 may include fewer or more components of work machine 10.

Work machine 10 may also be configured to remove material 24 to form transition region 80. Material 24 may be removed from surface 26 to form new surface 30 including transition region 80. Surfacing components 48 (not shown) may include any components of work machine 10 configured to remove material 24 and/or control the removal of material 24. For example, surfacing components 48 (not shown) may include a milling drum, a blade, devices to fragment, scarify, and/or heat material 24, or any devices for removing material 24 known in the art. It is also contemplated that surfacing components 48 not shown may include a milling drum height actuator, a blade height actuator, a milling drum motor, a blade motor, or any component of work machine 10 configured to control the removal of material 24.

To input data representative of transition region 80 into TRCS 58, work machine 10 may include any device and/or system to input data, such as, for example, data input system 74. Data input system 74 may be configured to receive data representative of transition region 80 and/or any data related to the operation of work machine 10. In particular, data input system 74 may include devices and/or systems mounted on work machine 10, such as, for example, console 46. Data input system 74 may include a button, a switch, a dial, a keypad, a touch-screen, or any other data input device known in the art.

Controller 50 may be embodied in a single microprocessor or multiple microprocessors configured to monitor and/or control a function of TRCS 58. Numerous commercially available microprocessors can be configured to perform a function of controller 50. It should be appreciated that controller 50 could readily be embodied in a general microprocessor capable of controlling one or more functions of work machine 10. Controller 50 may include a memory, a secondary storage device, a processor, and any other components for operating a function of controller 50. Various other circuits may be associated with controller 50. For example, controller 50 may include or be operatively connected to power supply circuitry, signal conditioning circuitry, solenoid driver circuitry, and/or any other types of suitable circuitry.

Controller 50 may be configured to receive, process and output data to one or more components of TRCS 58. For example, controller 50 may be configured to receive a signal from sensor 34 representative of a speed of work machine 10. Controller 50 may be configured to determine a speed of work machine 10 based on the signal received from sensors 34.

In an exemplary embodiment, data input system 74 may transmit data representative of transition region 80 to controller 50. The data transmitted to controller 50 may include one or more parameters defining the shape of transition region 80. For example, transition region 80 may be defined by a slope, an angle or any parameter that may partially define the geometry of transition region 80.

Controller 50 may be configured to output one or more signals to control one or more components of TRCS 58. Specifically, controller 50 may be configured to control surfacing components 48 such that work machine 10 may form transition region 80 as described above. For example, controller 50 may control screed height actuator 62 such that the distance between screed 20 and surface 26 may gradually decrease as work machine 10 moves forward. As shown in FIG. 1, by decreasing the height of screed 20 as work machine 10 moves forward, transition region 80 may be formed by decreasing the height of material 24 formed on surface 26.

In some embodiments, controller 50 may control the formation of transition region 80 by controlling multiple components of work machine 10. For example, controller 50 may control the height of screed 20 based on the speed of work machine 10. As work machine 10 moves forward, the height of screed 20 may gradually decrease and less material 24 may be required to form new surface 30. As less material 24 is required, controller 50 may control conveyer motor 66 to decrease the amount of material 24 deposited in pile 56. In other embodiments controller 50 may control auger 28, auger height actuator 68, auger motor 70 and/or any other surfacing components 48 during the formation of transition region 80.

Figure 3A:
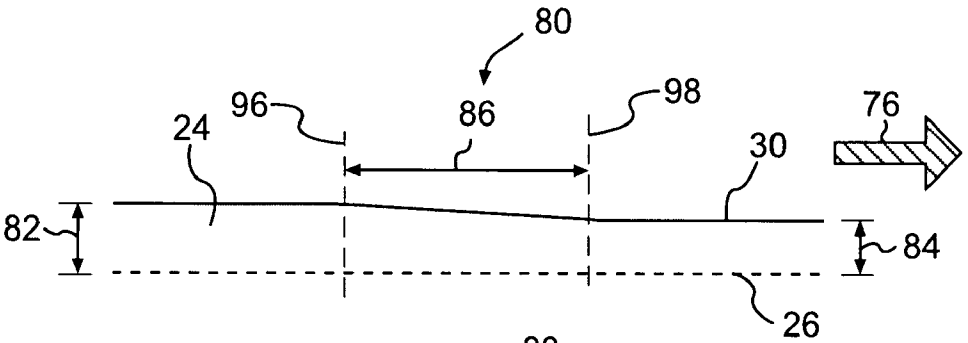
FIG. 3A is a side-view representation of a transition region, according to an exemplary embodiment.

FIG. 3A is a side-view representation of transition region 80, according to an exemplary embodiment. As shown in FIG. 1 and FIG. 3A, transition region 80 may be formed by the movement of work machine 10 as indicated by an arrow 76. As noted above, transition region 80 may be formed by decreasing the height of material 24 formed on surface 26 as work machine 10 moves forward as indicated by arrow 76.

To define transition region 80 using work machine 10, an operator may input a parameter representative of transition region 80 using data input system 74. For example, an operator may enter a slope of transition region 80 using a dial, wherein the dial includes settings representing a slope percentage. In some embodiments, an operator may enter an angle of the slope of transition region 80, a transition length 86 and the difference between an initial height 82 of material 24 and a final height 84 height of material 24, or any other parameter associated with transition region 80.

As shown in FIG. 3A, initial height 82 may be greater than final height 84. In other embodiments, work machine 10 may form transition region 80 wherein initial height 82 may be less than final height 84. For example, work machine 10 may form transition region 80 by increasing the height of material 24 formed on surface 26 as work machine 10 moves forward.

During operation work machine 10 may reach a beginning point 96, defining the beginning of transition region 80. Upon reaching beginning point 96, an operator may initiate formation of transition region 80 using data input system 74. For example, an operator may press a button, or flip a switch, to initiate the formation of transition region 80. It is also contemplated that controller 50 may initiate formation of transition region 80 based on a remote signal, such as, for example, a wireless signal transmitted from a remote source or a radio-frequency tag placed at beginning point 96.

Following beginning point 96, controller 50 may control one or more surfacing components 48 to control the formation of transition region 80 as noted above. For example, controller 50 may gradually reduce the height of screed 20 as work machine 10 moves forward and/or may control multiple surfacing components 48 during the formation of transition region 80.

In some embodiments, controller 50 may discontinue formation of transition region 80 at an ending point 98. For example, an operator may signal ending point 98 using data input system 74, such as, for example, by pressing a button. It is also contemplated that controller 50 may determine ending point 98 based on transition length 86, final height 84, and/or any other parameter associated with transition region 80.

Figure 3B:
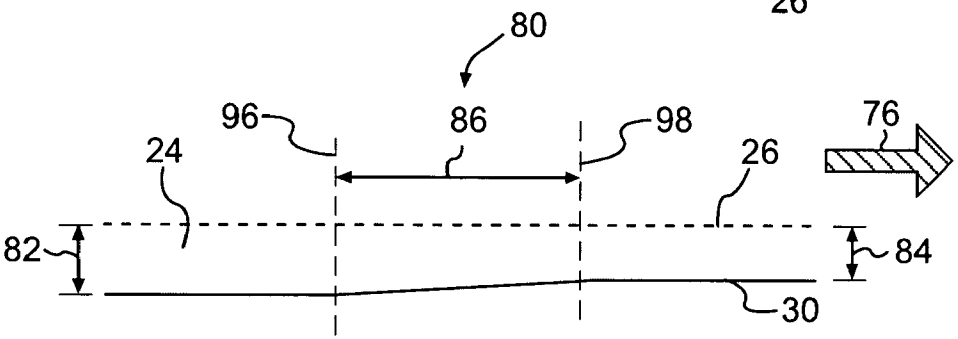
FIG. 3B is a side-view representation of a transition region, according to an exemplary embodiment.

FIG. 3B is a side-view representation of transition region 80, according to another exemplary embodiment. As previously discussed, material 24 may be removed from surface 26 by work machine 10 to form new surface 30. In some embodiments, work machine 10 may include one or more surfacing components 48 (not shown) configured to remove material 24, such as, for example, a milling drum, a blade, etc. As work machine 10 moves forward as indicated by arrow 76, transition region 80 may be formed by decreasing the height of material 24 removed from surface 26.

As noted above, an operator may define transition region 80 by inputting a parameter representative of transition region 80 using data input system 74. For example, an operator may enter a slope or angle of the slope of transition region 80, transition length 86 and the difference between initial height 82 and final height 84 of material 24 removed from surface 26, or any other parameter associated with transition region 80.

As shown in FIG. 3B, initial height 82 may be greater than final height 84. In other embodiments, work machine 10 may form transition region 80 wherein initial height 82 may be less than final height 84. For example, work machine 10 may form transition region 80 by increasing the depth of material 24 removed from surface 26 as work machine 10 moves forward as indicated by arrow 76.

An operator may initiate formation of transition region 80 as work machine 10 reaches beginning point 96 as noted above. Following beginning point 96, controller 50 may control surfacing components 48 to control the formation of transition region 80. For example, controller 50 may reduce the height of a milling drum (not shown) to reduce the height of material 24 removed from surface 26 as work machine 10 moves forward. In some embodiments, controller 50 may control multiple surfacing components 48 during the removal of material 24. For example, controller 50 may control a milling drum (not shown) and a blade (not shown) to ensure appropriate removal of material 24 during the formation of transition region 80. Further, controller 50 may discontinue formation of transition region 80 at ending point 98.

Figure 3C:
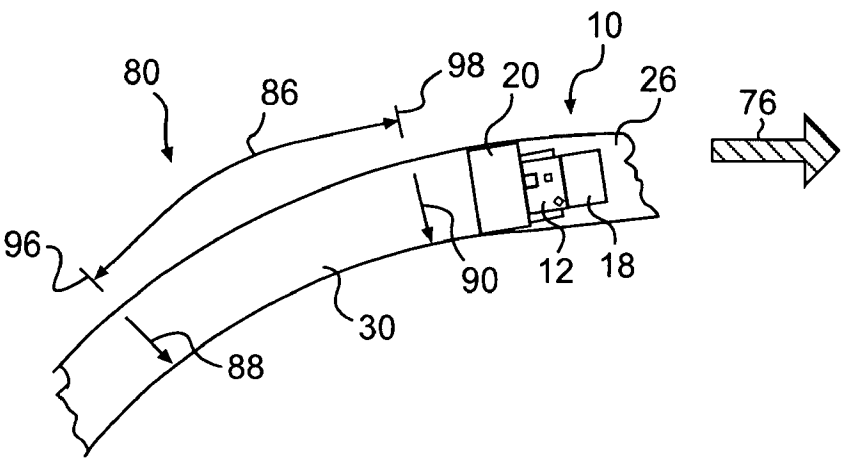
FIG. 3C is an aerial-view representation of a transition region, according to an exemplary embodiment.

FIG. 3C is an aerial-view representation of transition region 80, according to another exemplary embodiment. FIG. 3C illustrates work machine 10, tractor 12, hopper 18 and screed 20 moving forward over surface 26 as indicated by arrow 76 to form new surface 30. New surface 30 may include transition region 80 wherein transition region 80 may vary in superelevation. For example, a highway turn may require greater superelevations through some regions of the turn and lesser superelevations in other regions of the turn or state regulations may require that major roads include certain superelevations to maintain adequate roadway drainage.

As described above, an operator may define transition region 80 by inputting a parameter representative of transition region 80 using data input system 74. For example, an operator may enter an initial superelevation 88, a final superelevation 90, transition length 86, or any other parameter associated with transition region 80. For example, initial superelevation 88 may be 1.5% and final superelevation 90 may be 3.6%.

As previously described, an operator may initiate formation of transition region 80 as work machine 10 reaches beginning point 96. Following the beginning of transition region 80, controller 50 may control surfacing components 48 to form varying superelevations within transition region 80. For example, controller 50 may control the cross-slope of screed 20 by independently controlling the left and right-side screed height actuators 62. In some embodiments, controller 50 may independently control the rate of change of left and right-side screed height actuators 62 to vary the cross-slope of screed 20 as work machine 10 moves forward. Material 24 may be compacted and form varying superelevations based on the varying cross-slope of screed 20. In other embodiments, controller 50 may control multiple surfacing components 48 during the formation of transition region 80. For example, controller 50 may independently control auger motors 70 and/or auger height actuators 68 to laterally distribute material 24 sufficient to form varying superelevations.

It is contemplated that systems, devices and/or methods described above may include additional, fewer and/or different features than listed above. It is understood that the type and number of listed features are illustrative and not intended to be limiting.

INDUSTRIAL APPLICABILITY

Road re-surfacing operations often require the removal of worn existing material and the smooth application of fresh surfacing material. Typically, the height of surfacing material removed or added is generally coplanar with a sub-layer, or base-layer, of the road. However, in some situations it may be beneficial to form transition region 80 wherein the height of material 24 removed from or added to the existing surface may vary and may not be generally coplanar with the sub-layer.

Work machine 10 may be used to form new surface 30, wherein new surface 30 may include transition region 80 of varying height and/or superelevation of material 24. Work machine 10 may form transition region 80 using surfacing components 48 configured to add or remove material 24. In some embodiments, work machine 10 may also include TRCS 58 configured to control one or more surfacing components 48 to at least partially control the formation of transition region 80.

TRCS 58 may provide more accurate and/or precise formation of transition region 80 than traditional manual techniques. For example, TRCS 58 may reduce the need for grading stakes or other reference points used to ensure an appropriate thickness of material 24 is added or removed from surface 26. In addition, TRCS 58 may reduce reliance upon additional operators to monitor and/or control one or more components of work machine 10 during the formation of transition region 80.

TRCS 58 may also simplify the formation of transition region 80. For example, at least partially automating one or more components of work machine 10 may allow operators with less experience or a lower skill level to achieve high quality results. In some embodiments, an operator may enter one or more parameters representing the shape of transition region 80 and determine beginning point 96. TRCS 58 may then control one or more surfacing components 48 to form transition region 80 while the operator may focus on other operations of work machine 10.

It will be apparent to those skilled in the art that various modifications and variations can be made in the disclosed system without departing from the scope of the disclosure. Additionally, other embodiments of the disclosed system will be apparent to those skilled in the art from consideration of the specification. It is intended that the specification and examples be considered as exemplary only, with a true scope of the disclosure being indicated by the following claims and their equivalents.

What is claimed is:

1. A transition region control system for a mobile machine comprising:

one or more sensors configured to transmit a signal representative of a travel parameter of the mobile machine relative to an existing first surface;

one or more surfacing components configured to transform the existing first surface into a second surface;

an input system configured to receive, from a user, transition region information including a transition beginning point on the existing first surface, a transition ending point on the existing first surface, and one of a relative height difference or a slope between the transition beginning and ending points; and a controller in communication with the one or more sensors, the one or more surfacing components, and the input system, the controller being configured to:

detect a remote signal indicative of the mobile machine reaching the transition beginning point;

adjust the one or more surfacing components to transform the existing first surface into the second surface based on the travel parameter, the transition region information, and detection of the remote signal;

make a determination that the mobile machine has reached the transition ending point based on one of a distance of the mobile machine from the transition beginning point or a height of the second surface at a current location of the mobile machine; and stop transforming the existing first surface into the second surface based on the determination, wherein the second surface between the transition beginning and ending points has a slope different than a slope of the existing first surface at one or both of the transition beginning and ending points.

2. The transition region control system of claim 1, wherein the one or more surfacing components includes at least one of a screed, an auger, a conveyer, a screed height actuator, an auger height actuator, a conveyer motor, and an auger motor.

3. The transition region control system of claim 1, wherein the one or more surfacing components includes at least one of a milling drum, a blade, a device to fragment the existing first surface, a device to heat the first surface, a milling drum height actuator, a blade height actuator, a milling drum motor, and a blade motor.

4. The transition region control system of claim 1, wherein the second surface is not aligned with the existing first surface in a travel direction of the mobile machine.

5. The transition region control system of claim 1, wherein the second surface is not aligned with the existing first surface in a direction substantially perpendicular to a travel direction of the mobile machine.

6. The transition region control system of claim 1, wherein the input system includes at least one of a button, a switch, a dial, a keypad, or a touch-screen.

7. The transition region control system of claim 1, wherein the transition region information includes a superelevation.

8. A method for controlling a mobile machine comprising:

determining a travel parameter of the mobile machine relative to an existing first surface;

receiving, from a user, transition region information including a transition beginning point on the existing first surface, a transition ending point on the existing first surface, and one of a relative height difference or slope between the transition beginning and ending points;

detecting a remote signal indicative of the mobile machine reaching the transition beginning point;

adjusting one or more surfacing components to transform the existing first surface into a second surface based on the travel parameter of the mobile machine, the transition region information, and detection of the remote signal;

making a determination that the mobile machine has reached the transition ending point based on one of a distance from the transition beginning point or a height of the second surface at a current location of the mobile machine; and stopping transformation of the existing first surface into the second surface based on the determination, wherein the second surface between the transition beginning and ending points has a slope different than a slope of the existing first surface at one or both of the transition beginning and ending points.

9. The method of claim 8, wherein the one or more surfacing components includes at least one of a screed, an auger, a conveyer, a screed height actuator, an auger height actuator, a conveyer motor, and an auger motor.

10. The method of claim 8, wherein the one or more surfacing components includes at least one of a milling drum, a blade, a device to fragment the material, a device to heat the material, a milling drum height actuator, a blade height actuator, a milling drum motor, and a blade motor.

11. The method of claim 8, wherein the second surface is not aligned with the existing first surface in a travel direction of the mobile machine.

12. The method of claim 8, wherein the second surface is not aligned with the existing first surface in a direction substantially perpendicular to a travel direction of the mobile machine.

13. The method of claim 8, wherein the transition region information is received via at least one of a button, a switch, a dial, a keypad, or a touch-screen.

14. The method of claim 8, wherein the transition region information includes a superelevation.

15. A mobile machine comprising:

a power source configured to propel the mobile machine;

one or more sensors configured to transmit a signal representative of a speed of the mobile machine relative to an existing first surface;

one or more surfacing components configured to transform the existing first surface into a second surface; and an input system configured to receive, from a user, transition region information including a transition beginning point on the existing first surface, a transition ending point on the existing first surface, and one of a relative height difference or a slope between the transition beginning and ending points; and a controller in communication with the one or more sensors, the one or more surfacing components, and the input system, the controller being configured to:

detect a remote signal indicative of the mobile machine reaching the transition beginning point;

control at least one of the one or more surfacing components to transform the existing first surface into the second surface based on the travel parameter, the transition region information, and detection of the remote signal;

make a determination that the mobile machine has reached the transition ending point based on one of a distance from the transition beginning point or a height of the second surface at the current location of the mobile machine; and stop transforming the existing first surface into the second surface based on the determination, wherein the second surface between the transition beginning and ending points has a slope different than a slope of the existing first surface at one or both of the transition beginning and ending points.

16. The mobile machine of claim 15, wherein the one or more surfacing components includes at least one of a screed, an auger, a conveyer, a screed height actuator, an auger height actuator, a conveyer motor, and an auger motor.

17. The mobile machine of claim 15, wherein the one or more surfacing components includes at least one of a milling drum, a blade, a device to fragment the existing first surface, a device to heat the existing first surface, a milling drum height actuator, a blade height actuator, a milling drum motor, and a blade motor.

18. The mobile machine of claim 15, wherein the second surface is not aligned with the existing first surface in a travel direction of the mobile machine.

19. The mobile machine of claim 15, wherein the second surface is not aligned with the existing first surface in a direction substantially perpendicular to a travel direction of the mobile machine.

20. The mobile machine of claim 15, wherein the input system includes at least one of a button, a switch, a dial, a keypad, or a touch-screen.

21. The mobile machine of claim 15, wherein the transition region information includes a superelevation.

* * * * *